US012607388B2

(12) United States Patent
Yamaguchi et al.

(10) Patent No.: US 12,607,388 B2
(45) Date of Patent: Apr. 21, 2026

(54) REFRIGERANT CIRCUIT FOR A REFRIGERATION APPARATUS WITH A THERMAL STORAGE AND METHOD FOR CONTROLLING A REFRIGERANT CIRCUIT

(71) Applicants: DAIKIN INDUSTRIES, LTD., Osaka (JP); DAIKIN EUROPE N.V., Ostend (BE)

(72) Inventors: Takahiro Yamaguchi, Ostend (BE); Stefan Vandaele, Ostend (BE); Kris Van De Velde, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 191 days.

(21) Appl. No.: 18/032,961

(22) PCT Filed: Nov. 4, 2021

(86) PCT No.: PCT/JP2021/040591
§ 371 (c)(1),
(2) Date: Apr. 20, 2023

(87) PCT Pub. No.: WO2022/097680
PCT Pub. Date: May 12, 2022

(65) Prior Publication Data

US 2023/0392829 A1 Dec. 7, 2023

(30) Foreign Application Priority Data

Nov. 5, 2020 (EP) ..... 20205893
Nov. 5, 2020 (EP) ..... 20205894
Nov. 5, 2020 (EP) ..... 20205899

(51) Int. Cl.
*F25B 9/00* (2006.01)
*F25B 41/20* (2021.01)
*F25B 41/40* (2021.01)

(52) U.S. Cl.
CPC ..... *F25B 9/008* (2013.01); *F25B 41/20* (2021.01); *F25B 41/40* (2021.01); *F25B 2400/24* (2013.01)

(58) Field of Classification Search
CPC ..... F25B 9/008; F25B 2339/042; F25B 2339/046; F25B 2700/2111;
(Continued)

(56) References Cited

U.S. PATENT DOCUMENTS 9,581,359 B2 * 2/2017 Kang ..... F25B 13/00
9,765,977 B2 * 9/2017 Fujitsuka ..... F24F 5/0017
(Continued)

FOREIGN PATENT DOCUMENTS

EP 1 550 830 A1 7/2005
EP 1 607 696 A2 12/2005
(Continued)

OTHER PUBLICATIONS

WO-2014061131-A1 English Translation (Year: 2014).*
(Continued)

*Primary Examiner* — Devon T Moore
(74) *Attorney, Agent, or Firm* — Birch, Stewart, Kolasch & Birch, LLP

(57) ABSTRACT

A refrigerant circuit for a refrigeration apparatus with a thermal storage, which is using $CO_2$ as refrigerant, includes: at least one compressor, a heat-source-side heat exchanger, an expansion device, and a thermal storage, including a thermal storage material, which is preferably a phase changing material from the group: organic PCMs like bio-based, paraffin, carbohydrate or lipid derived, or water. The refrig-
(Continued)

erant circuit further includes: a first fluid communication pipe communicating between a fluid side of the heat-source-side heat exchanger and one side of the thermal storage, and a second fluid communication pipe communicating between the expansion device and the other side of the thermal storage.

14 Claims, 11 Drawing Sheets

(58) Field of Classification Search
CPC ..... F25B 2700/2106; F25B 2700/2116; F25B 2700/21163; F25B 2700/1931; F25B 2600/25; F25B 2600/2507; F25B 2600/2515; F25B 41/40; F25B 40/02; F25B 41/20; F25B 2400/24; F28D 2021/0061
See application file for complete search history.

(56) References Cited

U.S. PATENT DOCUMENTS

| | | | | |
|---|---|---|---|---|
| 9,970,688 | B2 * | 5/2018 | Park | F25B 49/02 |
| 2019/0264933 | A1 | 8/2019 | Ignatiev et al. | |

FOREIGN PATENT DOCUMENTS

| | | | | |
|---|---|---|---|---|
| EP | 2 402 681 | A1 | 1/2012 | |
| EP | 2771 627 | A1 | 9/2014 | |
| EP | 3 222 934 | A1 | 9/2017 | |
| EP | 3 242 096 | A1 | 11/2017 | |
| EP | 2 844 924 | B1 | 4/2019 | |
| JP | 2020-56565 | A | 4/2020 | |
| WO | WO 00/33002 | A1 | 6/2000 | |
| WO | WO 2013/062287 | A1 | 5/2013 | |
| WO | WO-2014061131 | A1 * | 4/2014 | F25B 13/00 |
| WO | WO 2015/173940 | A1 | 11/2015 | |
| WO | WO-2015177852 | A1 * | 11/2015 | F25B 13/00 |

OTHER PUBLICATIONS

WO-2015177852-A1 English Translation (Year: 2015).*
European Search Report, issued in EP Application No. 20205893.9, dated Apr. 1, 2021.
European Search Report, issued in EP Application No. 20205894.7, dated Apr. 9, 2021.
European Search Report, issued in EP Application No. 20205899.6, dated Apr. 8, 2021.
International Search Report for PCT/JP2021/040591 mailed on Jan. 26, 2022.
Written Opinion of the International Searching Authority for PCT/JP2021/040591 mailed on Jan. 26, 2022.
International Preliminary Report on Patentability and English translation of the Written Opinion of the International Searching Authority for International Application No. PCT/JP2021/040591, dated May 19. 2023.

* cited by examiner

[Fig. 1]

(Prior Art)

[Fig. 3]
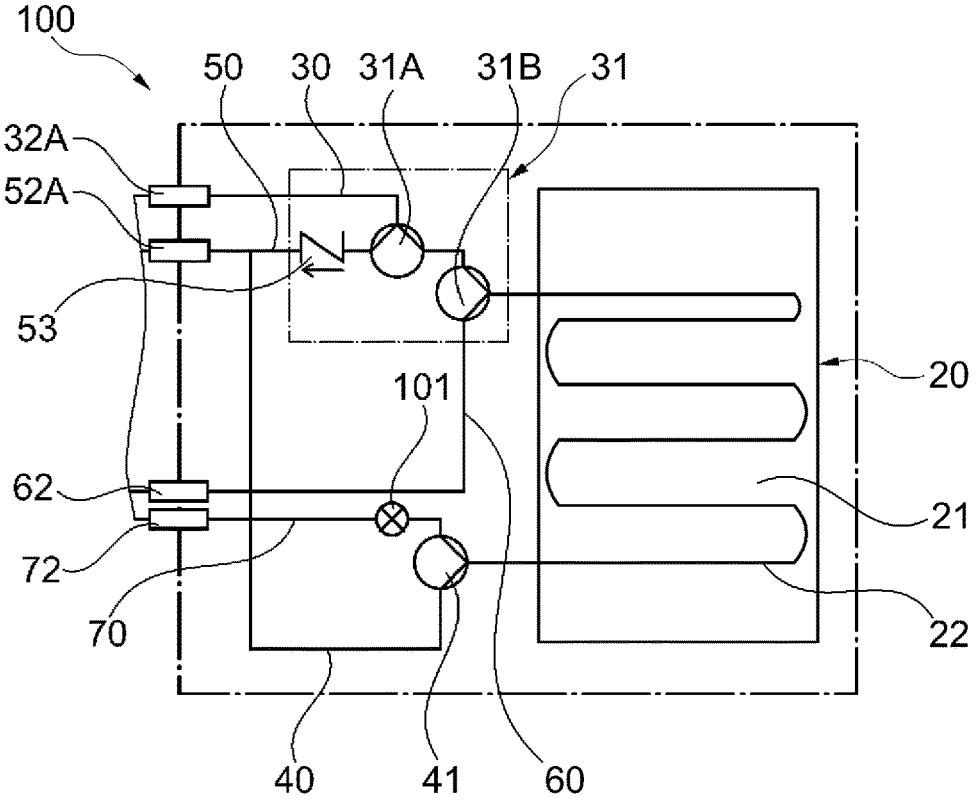
[Fig. 4]
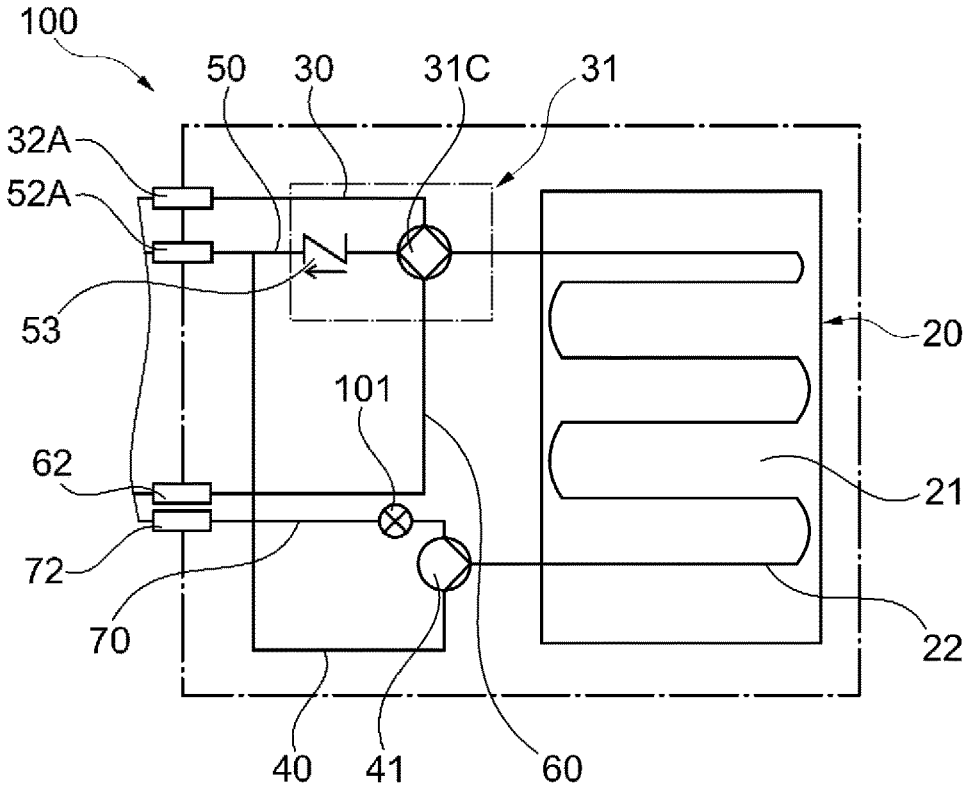

[Fig. 5]
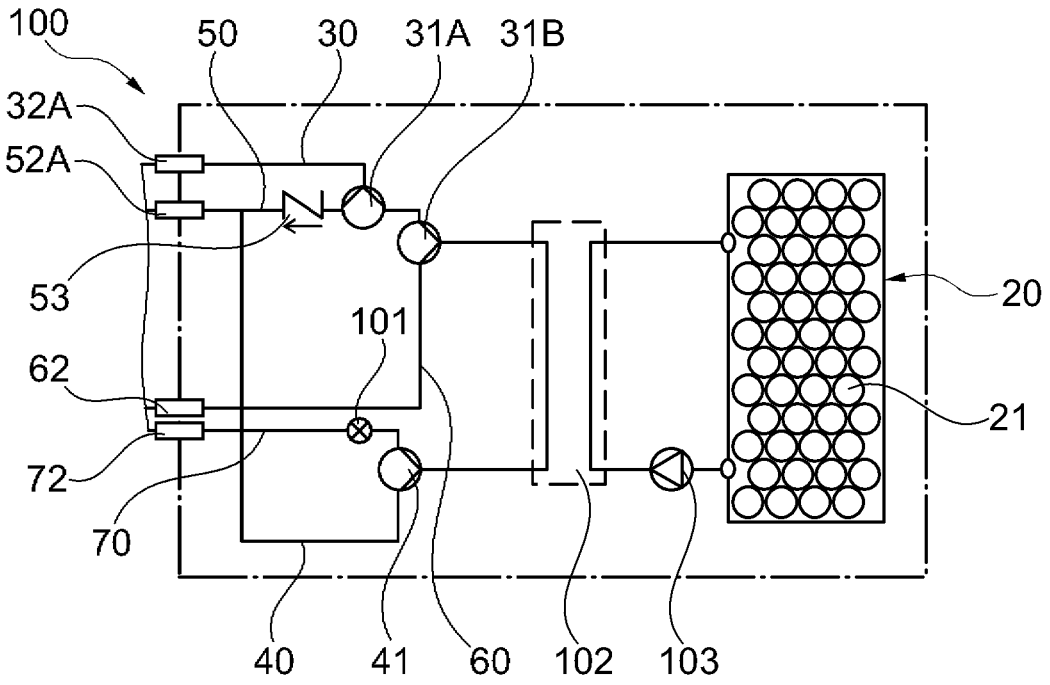
[Fig. 6]
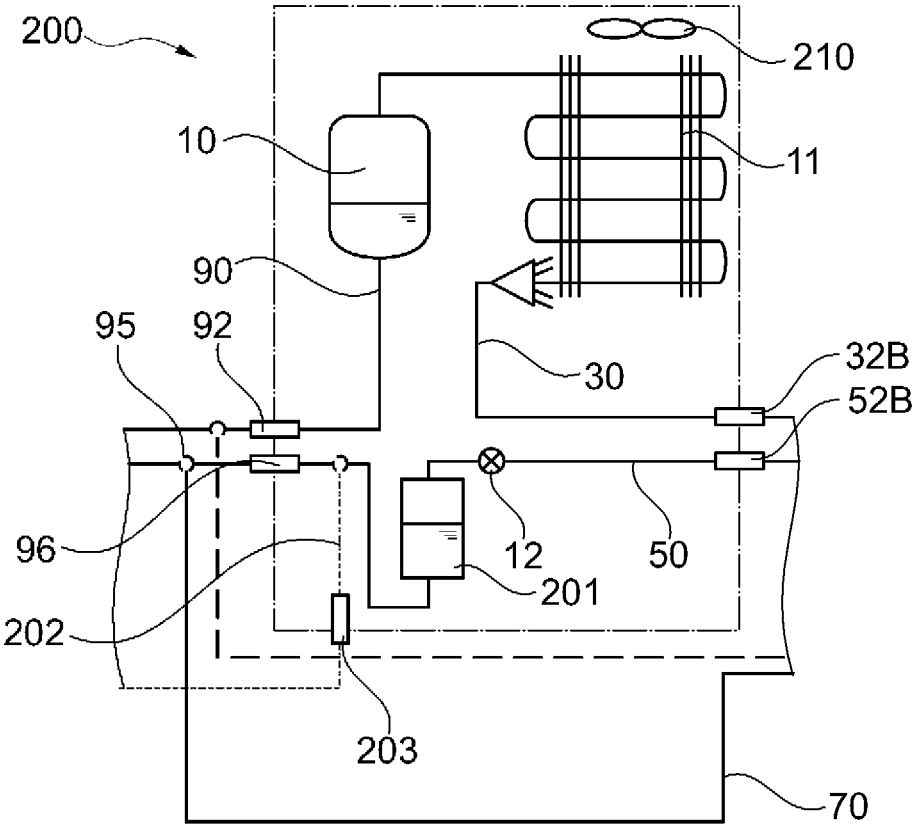

[Fig. 13]
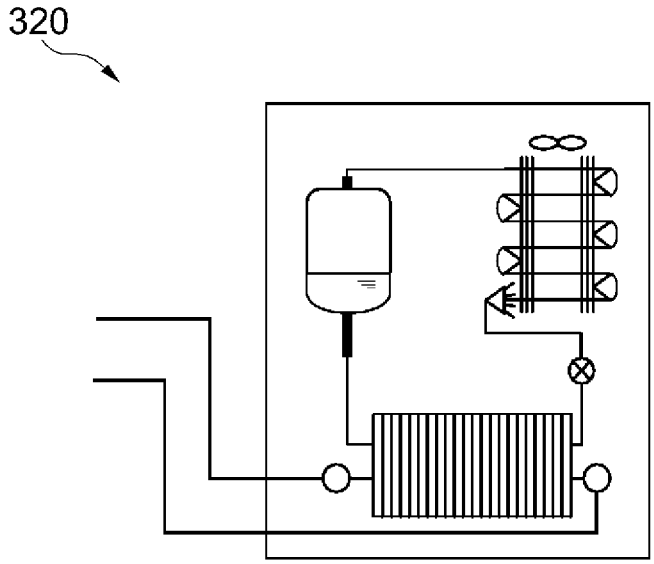
[Fig. 14]
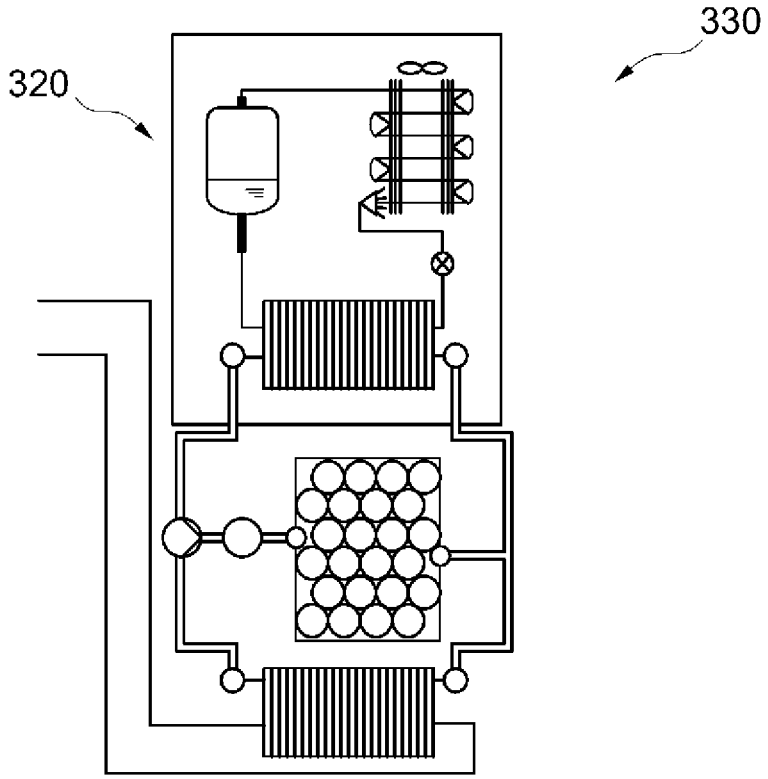

REFRIGERANT CIRCUIT FOR A REFRIGERATION APPARATUS WITH A THERMAL STORAGE AND METHOD FOR CONTROLLING A REFRIGERANT CIRCUIT

TECHNICAL FIELD

The present disclosure relates to a refrigerant circuit for cooling and/or heating purposes. In particular, the disclosure relates to a refrigerant circuit for a refrigeration apparatus with a thermal storage particularly a thermal storage with a phase changing material (PCM). Even more particular, the disclosure relates to a refrigerant circuit for a refrigeration apparatus with a thermal storage using $CO_2$ as a refrigerant.

BACKGROUND ART

As described in EP 2 402 681 A1, conventionally, a refrigerating apparatus has been known, which includes a refrigerant circuit performing a refrigeration cycle. The refrigerating apparatus of this type has been widely used for coolers such as refrigerators and freezers for storing food etc. and air conditioners for cooling/heating an inside of a room.

Moreover, EP 2 844 924 B1 discloses an air-conditioning system comprising: a chiller system including a compressor, a condenser, an expansion device and an evaporator, a phase change material in thermal communication with the condenser, an actuator coupled to the phase change material; and a controller providing a trigger signal to the actuator to initiate changing the phase change material from a supercooled state to a solid state, wherein the phase change material includes a coolant supply line in thermal communication with the phase change material and the coolant supply line is coupled to the chiller system. The phase change material is selected so that the phase change material transitions from liquid to solid when cooling demand on the chiller system is low or non-existent. This may occur in the evening, when ambient temperatures are lower. During the day, the solid or frozen phase change material absorbs energy from the condenser, improving the efficiency of the condenser when the chiller system is running and increasing efficiency and capacity of the chiller system.

The air-conditioning system described in EP 2 844 924 B1 aims to provide a system that is capable of balancing cooling demand by using a phase change material as a heat buffer between the condenser and the ambient air temperature. During the day, the phase change material absorbs the heat from the condenser and release it to the outside air. Due to its thermal capacity and the latent heat release, the phase change material will heat up slower than air and thus result in higher energy efficiency. At night, the phase change material is cooled down faster by the fresher air temperature using the fan only.

However, active cooling of the phase change material with the fan is inefficient, therefore, said system is particularly not suitable for regions with warmer climates, where air temperatures at night remain high. Moreover, the described system is not able to realize big improvements with regard to energy efficiency but will "flatten out" the energy consumption pattern due to the thermal response time of the phase change material. This is in particular true, since the active cooling of the phase change material also causes heating of the condenser, as the condenser is in thermal communication with the phase change material, and no control of the use of the phase change material is possible.

Additionally, fluorocarbon has been conventionally used as a refrigerant in refrigeration systems. However, following the Montreal Protocol in 1987 and the Kyoto Protocol in 1997, artificially developed substitute chlorofluorocarbons, whose ozone depletion potential is low, have become commonly used as refrigerants. Yet, in recent years, the development of technology using even more environmentally friendly substitutes, particularly using natural refrigerants such as carbon dioxide, ammonia, hydrocarbons (isobutene, propane, etc.), water and air, has progressed. These natural refrigerants are materials that have the property that, when compared with the afore-mentioned chlorofluorocarbons and substitute chlorofluorocarbons, their GWP (Global Warming Potential) value is extremely low.

Among these, carbon dioxide is known as a material whose ozone depletion potential is zero, whose global warming potential is also much lower in comparison to conventional refrigerants, which has no toxicity, is non-flammable, and whose efficiency in creating a high temperature is good among natural refrigerants, and from environmental/energy aspects and safety aspects, carbon dioxide is garnering attention as a refrigerant in air conditioners.

However, carbon dioxide ($CO_2$) performs at high outside temperatures with a lower efficiency than fluorinated refrigerants. Accordingly, on an annual base the performance of an air conditioner system using $CO_2$ as a refrigerant is lower compared to fluorinated refrigerants, particularly in warmer climates.

SUMMARY OF INVENTION

In view of the above, there is the desire to provide a refrigerant circuit for a refrigeration apparatus with a thermal storage, which is using carbon dioxide ($CO_2$) as refrigerant, allowing the storage of thermal energy, particularly cold, for example when outside temperatures are low, preferably during the night, and use the thermal energy during peak temperatures during the day when transcritical conditions occur or during peak demand, in order to substantially prevent a decrease in cooling efficiency, which is particularly due to the use of a natural refrigerant like carbon dioxide, while ensuring a high cooling capacity and providing flexibility with regard to charging the thermal storage with cold. Additionally, if circumstances require it or allow it, the provided refrigerant circuit should also be able to store thermal energy, particularly cold, even during peak temperatures when for example much/excess PV power ($CO_2$ neutral energy generation) is available.

This aim may be achieved by a refrigerant circuit as defined in claim 1. Embodiments may be found in the dependent claims, the following description and the accompanying drawings.

According to a first aspect of present disclosure, a refrigerant circuit for a refrigeration apparatus with a thermal storage, which is using carbon dioxide ($CO_2$) as refrigerant, includes: at least one compressor, a heat-source-side heat exchanger, an expansion device, and a thermal storage, including a thermal storage material, particularly a phase changing material (PCM) from the group: organic PCMs like bio-based, paraffin, carbohydrate or lipid derived, or water, wherein the refrigerant circuit further includes: a first fluid communication pipe communicating between a fluid side of the heat-source-side heat exchanger and one side of the thermal storage, and a second fluid communication pipe communicating between the expansion device and the other side of the thermal storage.

Hence, a refrigerant circuit is provided, capable of storing thermal energy, particularly cold, when for example outside temperatures are low, and using the stored thermal energy during peak temperatures during the day when transcritical conditions occur or during peak demand, in order to substantially prevent a decrease in cooling efficiency, which is particularly due to the use of a natural refrigerant like carbon dioxide, while ensuring a high cooling capacity and providing flexibility with regard to charging the thermal storage with cold. Additionally, the provided refrigerant circuit also allows to store thermal energy, particularly cold, during peak temperatures, if other circumstances require it or make it possible, like for example excess of PV (photovoltaic) power or other $CO_2$ neutral generated electric power. Accordingly, the provided refrigerant circuit can not only store thermal energy when low outside temperatures allow it, but also by availability of excessive renewable electricity, which in total will decrease $CO_2$ emissions even further, even if the refrigerant circuit is less efficient.

As regards the term "natural" concerning the "natural refrigerant", the term defines in the present disclosure refrigerants that occur naturally.

Moreover, in the present disclosure the term "fluid" concerning the "fluid communication pipe(s)" and the "fluid port(s)" is used as the fluid, particularly the $CO_2$, flowing there through is in a supercritical condition (supercritical fluid), which means, the fluid is at a temperature and pressure above its critical point, where distinct liquid and gas phases do not exist. Accordingly, the "fluid communication pipe(s)" and the "fluid port(s)" are common "liquid communication pipe(s)" and "liquid port(s)", only emphasizing that the fluid flowing there through is in a supercritical condition.

According to a second aspect, the refrigerant circuit further includes a first switching mechanism located/provided on the first fluid communication pipe and communicating among the heat-source-side heat exchanger, the thermal storage, a third fluid communication pipe, and a first gas communication pipe, wherein the third fluid communication pipe communicates to the expansion device and the first gas communication pipe communicates to a suction side of the compressor.

According to a third aspect, the first switching mechanism may include: a first valve, which is a three-way valve, communicating among the heat-source-side heat exchanger, the expansion device and the thermal storage, and preferably a second valve, which is a three-way valve and located/provided between the first valve and the thermal storage, communicating among the first valve, the thermal storage and the first gas communication pipe.

According to a fourth aspect, the first switching mechanism may include: a first valve, which is a four-way valve, communicating among the heat-source-side heat exchanger, the thermal storage, the first gas communication pipe and the expansion device, wherein the first switching mechanism preferably further comprises a check valve that stops a backflow from the third fluid communication pipe to the first valve.

According to a fifth aspect, the refrigerant circuit may include a second switching mechanism located/provided on the second fluid communication pipe and communicating among the thermal storage, the expansion device and a fourth fluid communication pipe, wherein the fourth fluid communication pipe is communicating to a utilization-side heat exchanger.

According to a sixth aspect, the second switching mechanism may be a valve, which is a three-way valve, communicating among the thermal storage, the expansion valve and the utilization-side heat exchanger, wherein preferably an expansion device is provided on the fourth fluid communication pipe, located/provided between the second switching mechanism and the utilization-side heat exchanger.

According to a seventh aspect, the refrigerant circuit further comprising a receiver, which is preferably located/provided on the third fluid communication pipe, preferably between the expansion device and a/the utilization-side heat exchanger, wherein the receiver is configured to separate liquid refrigerant and gas refrigerant.

According to a eighth aspect, the refrigerant circuit further includes a subcooling heat exchanger, which is preferably located/provided between a/the utilization-side heat exchanger and the expansion device, more preferably between the utilization-side heat exchanger and a/the receiver.

According to a ninth aspect, the refrigerant circuit further includes an expansion device, particularly a storage side expansion valve, located on the fourth fluid communication pipe and between the second switching mechanism and the utilization-side heat exchanger, and a controller configured to select modes of operation, wherein the modes comprise:

a normal refrigeration and/or cooling mode, a cold storage making mode and a cold storage using mode, wherein particularly:

in the normal refrigeration and/or cooling mode the first switching mechanism is set so that the first fluid communication pipe and the third fluid communication pipe are communicated, and the expansion device is closed, in the cold storage making mode the first switching mechanism is set so that the first fluid communication pipe and the third fluid communication pipe are communicated and the first gas communication pipe and the thermal storage are communicated, the second switching mechanism is set so that the fourth fluid communication pipe and the thermal storage are communicated, and the expansion device is opened, and in the cold storage using mode the first switching mechanism is set so that first fluid communication pipe and the thermal storage are communicated, the second switching mechanism is set so that the second fluid communication pipe and the thermal storage are communicated, and the expansion device is closed.

According to a tenth aspect, the refrigerant circuit may further include an outside temperature sensor, a gas cooler out temperature sensor, a thermal storage medium temperature sensor, and a discharge side pressure sensor, provided on the high pressure side of the at least one compressor.

According to a eleventh aspect, the refrigerant circuit may further include a thermal storage unit having the thermal storage and comprising a water circuit, a refrigerant to phase change material (PCM) circuit or a refrigerant to water to phase change material (PCM) circuit, wherein the refrigerant to water to phase change material (PCM) circuit includes a heat exchanger, particularly a plate heat exchanger, and a circulating pump.

According to a twelfth aspect, the refrigerant circuit may further include a thermal storage unit including the first switching mechanism and the second switching mechanism.

According to a thirteenth aspect, the refrigerant circuit with the receiver may further include a heat exchange unit including the receiver and the subcooling heat exchanger.

According to a fourteenth aspect, a method for controlling a refrigerant circuit, particularly the above described refrigerant circuit, for a refrigerant apparatus with a thermal storage which is using $CO_2$ as refrigerant, the method comprising different modes of operation, wherein the modes comprise:

a normal refrigeration and/or cooling mode, a cold storage making mode and a cold storage using mode, wherein:

in the normal refrigeration and/or cooling mode a first switching mechanism is set so that a first fluid communication pipe and a third fluid communication pipe are communicated, and an expansion device is closed, in the cold storage making mode the first switching mechanism is set so that the first fluid communication pipe and the third fluid communication pipe are communicated and a first gas communication pipe and the thermal storage are communicated, a second switching mechanism is set so that a fourth fluid communication pipe and the thermal storage are communicated, and the expansion device is opened, and in the cold storage using mode the first switching mechanism is set so that first fluid communication pipe and the thermal storage are communicated, the second switching mechanism is set so that the second fluid communication pipe and the thermal storage are communicated, and the expansion device is closed.

According to a fifteenth aspect, in the method the first fluid communication pipe may communicate between a fluid side of a heat-source-side heat exchanger and one side of the thermal storage, the second fluid communication pipe may communicate between an expansion device and the other side of the thermal storage, the third fluid communication pipe may communicate to the expansion device, and/or the first gas communication pipe may communicate to a suction side of at least one compressor.

The modes of operation may further include a simultaneous cold storage making and refrigeration and/or cooling mode, wherein the controller is configured to prioritize refrigeration and/or cooling over cold storage making.

Yet, the cold storage making mode may include: a cold storage making mode only and a cold storage making and a refrigeration and/or cooling mode, and the cold storage using mode comprises: a refrigerant and/or cooling and using cold storage mode.

The method for controlling a refrigerant circuit can be used for controlling the refrigerant circuit of the disclosure. The method can also be used for controlling the thermal storage unit described above, or vice versa. Therefore, the further features disclosed in connection with the above description of the method for controlling a refrigerant circuit may also be applied to the refrigerant circuit or the thermal storage unit of the disclosure. The same applies vice versa for the heat exchange unit.

A more complete appreciation of the present disclosure and many of the attendant advantages thereof will be readily obtained as the same becomes better understood by reference to the following detailed description when considered in connection with the accompanying drawings.

BRIEF DESCRIPTION OF DRAWINGS

FIG. 3 is a refrigerant circuit diagram illustrating a configuration of a thermal storage unit of a first embodiment;

FIG. 4 is a refrigerant circuit diagram illustrating a configuration of a thermal storage unit of a second embodiment;

FIG. 5 is a refrigerant circuit diagram illustrating a configuration of a thermal storage unit of a third embodiment;

FIG. 6 is a refrigerant circuit diagram illustrating a configuration of a heat exchange unit of a first embodiment;

FIG. 13 is a refrigerant circuit diagram illustrating a capacity increasing unit; and FIG. 14 is a refrigerant circuit diagram illustrating a combi unit having a capacity increasing unit and a thermal storage unit.

DESCRIPTION OF EMBODIMENTS

Several embodiments of the present disclosure will now be explained with reference to the drawings. It will be apparent to those skilled in the field of air-conditioning from this disclosure that the following description of the embodiments is provided for illustration only and not for the purpose of limiting the disclosure as defined by the appended claims.

Figure 1:
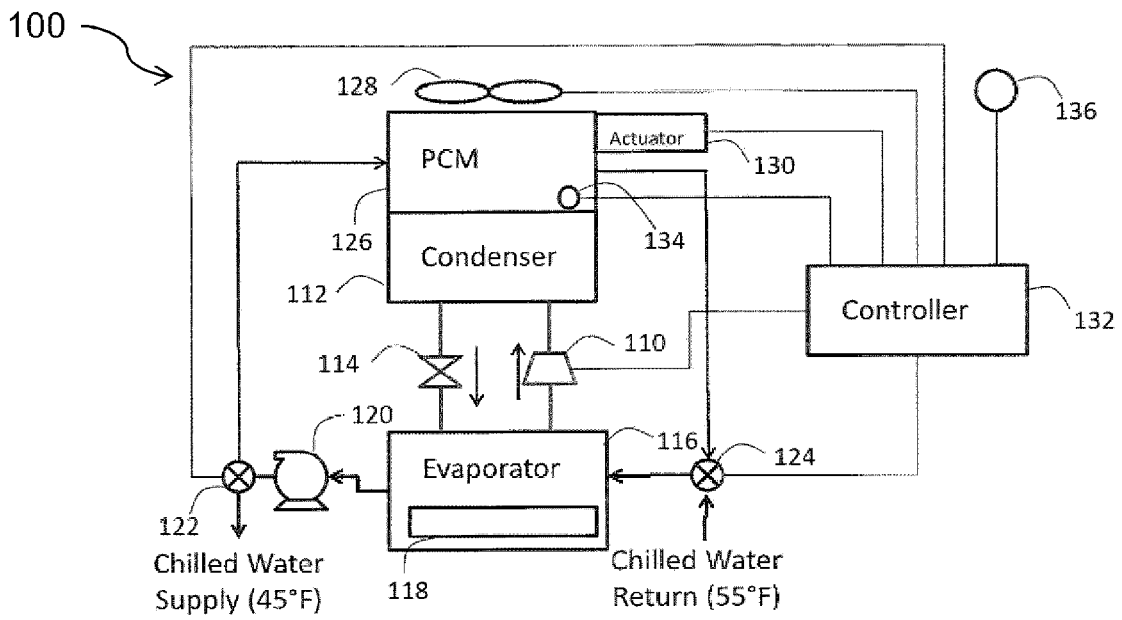
FIG. 1 shows a conventional air-conditioning system having a supercooled phase change material (PCM)

FIG. 1 shows a conventional air-conditioning system 100 having a supercooled phase change material (PCM). A chiller system includes a compressor 110, a first heat exchanger 112, an expansion device 114 and a second heat exchanger 116. The first heat exchanger 112 may be used as a condenser coil and may be located outside of a building or space to be conditioned. The second heat exchanger 116 may be used as an evaporator coil. As known in the art, refrigerant is subjected to a vapor compression cycle through compressor 110, condenser 112, expansion device 114 and evaporator 116. Heat is absorbed at evaporator 116 and heat is discharged at condenser 112.

The system of FIG. 1 may be a water chiller system. Evaporator 116 is in thermal communication with a heat exchanger 118 (e.g., a coil) that carries a fluid coolant, e.g., water. A supply pump 120 circulates coolant from heat exchanger 118 cooled by evaporator 116 to a supply valve 122. Supply valve 22 supplies chilled water to a local zone terminal where a fan draws air over a coil to chill a space as known in the art. A return valve 124 receives fluid returned from the local zone terminal and provides the return fluid to heat exchanger 118.

Moreover, the condenser coil 112 as shown in FIG. 1 is in thermal communication with a phase change material 126. A fan 128 draws air through the phase change material 126 to aid in cooling the phase change material 126. A controller 132 then initiates the transition of the phase change material 126 from supercooled liquid to solid. An actuator 130 is used to initiate the transition of the phase change material 126 from supercooled liquid to solid when the phase change material 126 is in a supercooled state. The actuator 130 includes a thermoelectric cooler for freezing the phase change material 126. Controller 132 receives a phase change material temperature signal from a phase change material sensor 134 and an ambient temperature signal from an ambient temperature sensor 136.

The phase change material 126 is selected so that the phase change material transitions from liquid to solid when cooling demand on the chiller system is low or non-existent. This may occur in the evening, when ambient temperatures are low. During the day, the solid or frozen phase change material 126 absorbs energy from the condenser 112 when the chiller system is running and increasing efficiency and capacity of the chiller system.

Figure 2:
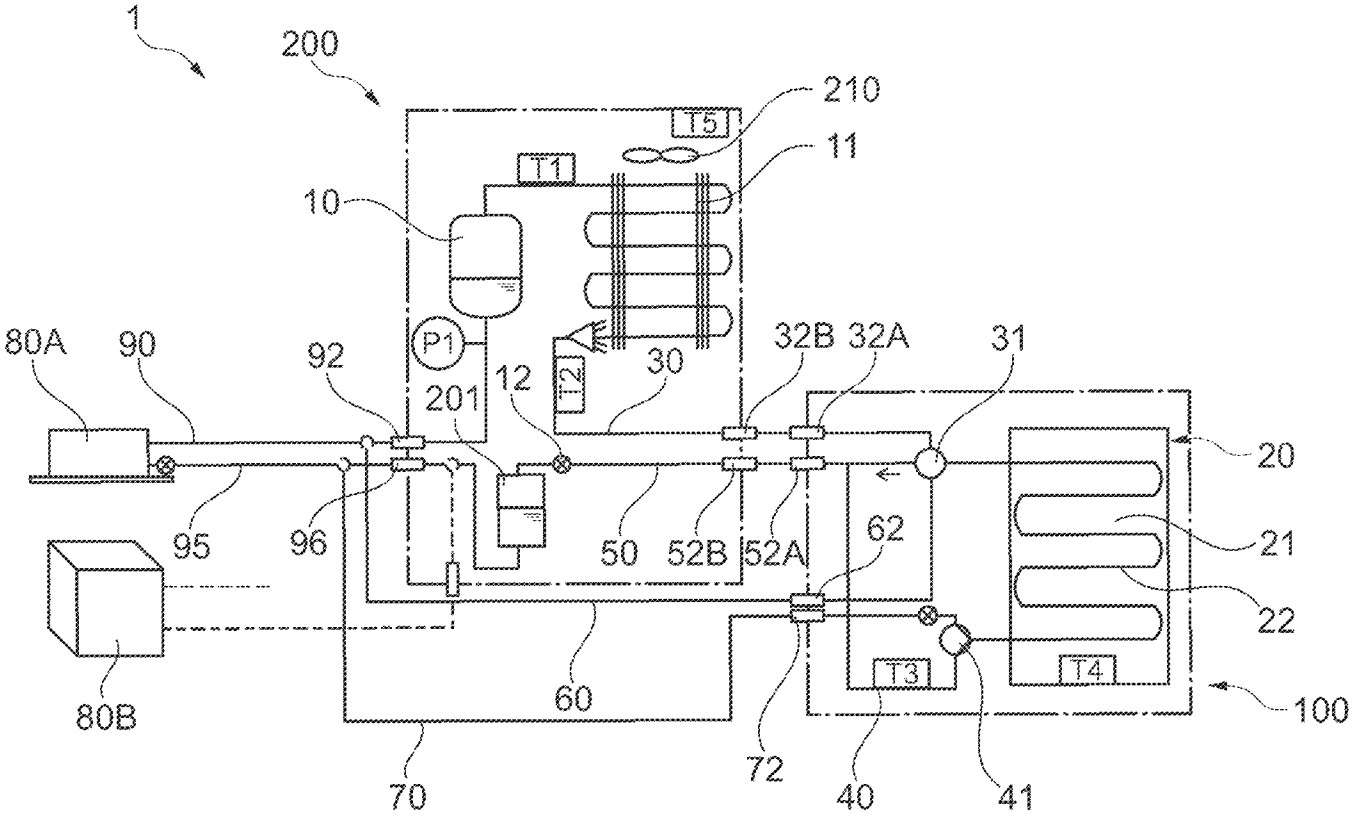
FIG. 2 is a refrigerant circuit diagram illustrating a configuration of a refrigerant circuit of a first embodiment.

Furthermore, FIG. 2 is a refrigerant circuit 1 diagram illustrating a configuration of a refrigerant circuit of a first embodiment. The shown refrigerant circuit uses $CO_2$ as refrigerant and includes one compressor 10, a heat-source-side heat exchanger of an outdoor unit of a so called "Conveni-Pack", including usually coolers such as refrigerators and freezers for storing food etc. and air conditioners (indoor units) for cooling/heating an inside of a room, particularly a show room/shopping room. In the shown refrigerant circuit only one indoor unit and one cooler are illustrated as example, but the refrigerant circuit can naturally include several coolers and air conditioners. The shown refrigerant circuit further includes a thermal storage unit 100 and a heat exchange unit 200, which will be explained later in more detail. The thermal storage unit 100 includes a thermal storage 20 including/accumulating a thermal storage material 21, which is a phase changing material (PCM). The shown refrigerant circuit further includes a first fluid communication pipe 30 that connects a fluid side of the heat-source-side heat exchanger 11 with one side of the thermal storage 20 and a second fluid communication pipe 40 that connects the expansion device 12 and the other side of the thermal storage 20.

In this regard, the term "connect" is used in the present disclosure to define that two entities, for example the "one side of the thermal storage" and the "thermal storage", are connected with each other by a connecting means such as a "liquid pipe" or a "gas pipe" in such a manner that a fluid like a refrigerant can be liquid-tight and gas-tight transferred/exchanged/flow from one entity to the other one. In other words, the connecting means provide a fluidic connection.

The refrigerant circuit 1 further includes a first switching mechanism 31, which is located on the first fluid communication pipe 30 and fluidically connects the heat-source-side heat exchanger 11, the thermal storage 20, a third fluid communication pipe 50 and a first gas communication pipe 60 with each other, wherein the third fluid communication pipe 50 is fluidically connecting to the expansion device 12 and the first gas communication pipe 60 is fluidically connecting to a suction side of the compressor 10.

The shown refrigerant circuit 1 further includes a second switching mechanism 41 located on the second fluid communication pipe 40 and fluidically connects the thermal storage 20, the expansion device 12 and a fourth fluid communication pipe 70 with each other, wherein the fourth fluid communication pipe 70 is fluidically connecting to a utilization-side heat exchanger 80A.

FIG. 2 also shows that the refrigerant circuit 1 further comprises a receiver 201, which is located on the third fluid communication pipe 50, between the expansion device 12 and the utilization-side heat exchanger 80A, wherein the receiver 201 is configured to separate the refrigerant coming from the expansion device 12 in a sub-critical state into liquid refrigerant and gas refrigerant.

The shown refrigerant circuit 1 also indicates that the refrigerant circuit 1 can further include an additional utilization-side heat exchanger 80B communicating on its liquid side with the expansion device 12 via the receiver 201 and on its gas side with the compressor 10.

As illustrated in FIG. 2, the utilization-side heat exchanger 80A can be a heat exchanger of an air-conditioner, particularly of an indoor unit, and the additional utilization-side heat exchanger 80B can be a heat exchanger of a cooler such as a refrigerator or a freezer.

FIG. 3 is a refrigerant circuit diagram illustrating a configuration of a thermal storage unit of a first embodiment. The shown thermal storage unit 100 is part of the above described refrigerant circuit 1, wherein the switching mechanism 1 is configured according to a first alternative. The shown thermal storage unit 100 includes the thermal storage 20 including the above described thermal storage material 21, which is a phase changing material (PCM), a thermal storage unit gas port 62 communicating to the utilization-side heat exchanger 80A, disposed outside the thermal storage unit 100, a first thermal storage unit fluid port 72 communicating to the utilization-side heat exchanger 80A, a second thermal storage unit fluid port 32A communicating to the heat-source-side heat exchanger 11, disposed outside the thermal storage unit 100, and a third thermal storage unit fluid port 52A communicating to the expansion device 12 disposed outside the thermal storage unit 100.

The shown thermal storage unit 100 further includes the first switching mechanism 31 communicating among the second thermal storage unit fluid port 32A, the third thermal storage fluid port 52A, the thermal storage unit gas port 62 and one side of the thermal storage 20, and the second switching mechanism 41 communicating among the first thermal storage unit fluid port 72, the third thermal storage unit fluid port 52A and the other side of the thermal storage 20.

Moreover, the in FIG. 3 shown thermal storage unit 100 further includes a refrigerant heat exchange pipe 22 that is disposed inside the thermal storage 20, particularly inside the thermal storage material 21. The first switching mechanism 31 is fluidically connected with one side of the refrigerant heat exchange pipe 22 and the second switching mechanism 41 is fluidically connected with the other end of the refrigerant heat exchange pipe 22.

According to the shown embodiment, the first switching mechanism 31 includes: a first valve 31A, which is a three-way valve, communicating among the second thermal storage unit fluid port 32A, the third thermal storage unit fluid port 52A and the thermal storage 20, and a second valve 31B, which is a three-way valve and located between the first valve 31A and the thermal storage 20, communicating among the first valve 31A, the thermal storage 20 and the thermal storage unit gas port 62.

Between the first valve 31A and the third thermal storage unit fluid port 52A is a check valve 31A provided that stops a backflow from the third thermal storage unit fluid port 52A to the first valve 31A.

The shown second switching mechanism 41 is a valve, which is a three-way valve, fluidically connecting the first thermal storage unit fluid port 72, the third thermal storage unit fluid port 52A and the thermal storage 20 with each other, wherein an expansion device 101 is located between the second switching mechanism 41 and the first thermal storage unit fluid port 72.

The second thermal storage unit fluid communication pipe 40 is connected with the third thermal storage unit fluid communication pipe 50 between the third thermal storage unit fluid port 52A and the check valve 53. A thermal storage unit gas communication pipe 60 fluidically connects the thermal storage unit gas port 62 and the first switching mechanism 31, particularly the second valve 31B, with each other.

FIG. 4 is a refrigerant circuit diagram illustrating a configuration of the thermal storage unit 100 according to a second embodiment, particularly an alternative configuration. The illustrated refrigerant circuit corresponds to the refrigerant circuit disclosed in FIG. 3 except the configuration of the first switching mechanism. In the shown alternative configuration, the first valve 31A is a four-way valve that fluidically connects the second thermal storage unit fluid port 32A, the thermal storage the thermal storage unit gas port 62 and the third thermal storage unit fluid port 52A.

FIG. 5 is a refrigerant circuit diagram illustrating a configuration of a thermal storage unit 100 according to a third embodiment, particularly a third alternative. The shown alternative does not use the above described refrigerant heat exchange pipe 22, instead uses a heat exchanger 102. As shown, the heat exchanger 102 is preferably a plate heat exchanger, which is on one side communicating with the first switching mechanism 31 and the second switching mechanism 41 and on the other side with the one side of the thermal storage 20 and the other side of the thermal storage 20.

Additionally, the thermal storage unit 100 includes a circulating pump 103 that is located on the second thermal storage unit fluid communication pipe 40, between the heat exchanger 102 and the thermal storage 20. Accordingly, the thermal storage has a closed loop, particularly using water as coolant. The circulating pump circulates the coolant through the thermal storage 20, thereby the coolant exchanges heat with the thermal storage material 21 of the thermal storage, and then to the heat exchanger 102, where the coolant again exchanges heat with the refrigerant of the refrigerant circuit 1. Hence, the circulating pump 103 is able to control the amount of thermal energy exchanged between the thermal storage 20, particularly the thermal storage material 21, and the refrigerant of the refrigerant circuit 1.

The in connection with FIG. 5 described embodiment can be combined with both alternatives with regard to the first switching mechanism, namely a first three-way valve or four-way valve 31A.

FIG. 6 is a refrigerant circuit diagram illustrating a configuration of a heat exchange unit 200 of a first embodiment. The shown heat exchange unit 200 includes the compressor 10, the heat-source-side heat exchanger 11 the expansion device 12, a heat exchange unit gas port 92 communicating to the utilization-side heat exchanger 80A disposed outside the heat exchange unit 200, a first heat exchange unit fluid port 96 communicating to the utilization-side heat exchanger 80A, a second heat exchange unit fluid port 32B communicating to the heat-source-side heat exchanger 11, a third heat exchange unit fluid port 52B communicating to the expansion device 12. The shown second heat exchange unit fluid port 32B is fluidically connected to the above described thermal storage unit 100 disposed outside the heat exchange unit 200 and the third heat exchange unit fluid port 52B is also fluidically connected to the thermal storage unit 100.

The shown heat exchange unit 200 further includes a heat exchange unit gas communication pipe 90 communicating between the heat exchange unit gas port 92 and the at least one compressor 10, a first heat exchange unit fluid communication pipe 30 communicating between the second heat exchange unit fluid port 32B and the heat-source-side heat exchanger 11, and a second heat exchange unit fluid communication pipe 50 communicating between the third heat exchange unit fluid port 52B and the first heat exchange unit fluid port 96.

The expansion device 12 is located on the second heat exchange unit fluid communication pipe 50, between the first heat exchange unit fluid port 96 and the third heat exchange unit fluid port 52B.

The shown heat exchange unit 200 further includes the above described receiver 201, which is located on the second heat exchange unit fluid communication pipe 50, between the first heat exchange unit fluid port 96 and the expansion device 12, wherein the receiver 201 is configured to separate liquid refrigerant and gas refrigerant. The heat exchange unit 200 further includes a fourth heat exchange unit fluid port 203 fluidically connecting the expansion device 12 and the additional utilization-side heat exchanger 80B disposed outside the heat exchange unit 200.

The shown heat exchange unit 200 further includes a third heat exchange unit fluid communication pipe 202 fluidically connecting the fourth heat exchange unit fluid port 203 with the expansion device 12 and is connected with the second heat exchange unit fluid communication pipe 50 between the first heat exchange unit fluid port 96 and the receiver 201.

Figure 7:
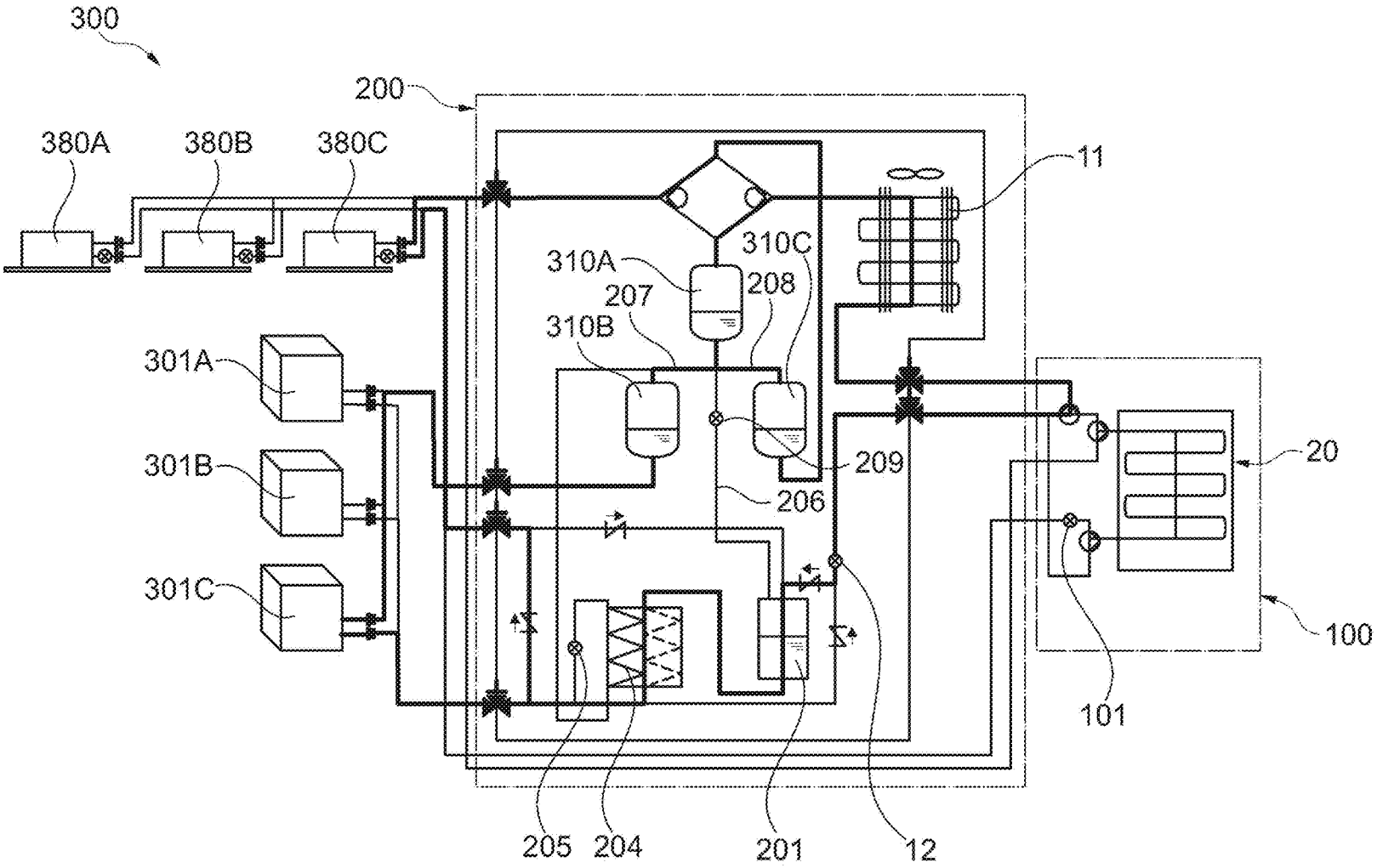
FIG. 7 is a refrigerant circuit diagram illustrating a configuration of a refrigeration apparatus of a first embodiment during a normal refrigeration and cooling operation.

FIG. 7 is a refrigerant circuit diagram illustrating a configuration of a refrigeration apparatus 300 of a first embodiment during a normal refrigeration and cooling operation. The shown refrigeration apparatus 300 includes the above described refrigerant circuit 1, the thermal storage unit 100 and the heat exchange unit 200, which are further detailed for explanatory purposes.

The shown heat exchange unit 200 further includes a subcooling heat exchanger 204, which is located between the first heat exchange unit fluid port 96 and the receiver 201.

The refrigeration apparatus 300 includes three coolers such as refrigerators and freezers for storing food etc. and three air conditioners (indoor units) for cooling/heating an inside of a room, particularly a show room/shopping room. The three indoor units are each provided with one utilization-side heat exchanger 380A-380C and the three refrigerators are each provided with one additional utilization-side heat exchanger 301A-301C.

Additionally, the shown heat exchange unit 200 further includes a second compressor 310B and a third compressor 310C that are provided parallel to each other and upstream of the above described compressor 10 of the basic configuration. In this way, the three compressors 310A-310B build a two-stage compressor system, wherein the second compressor 310B communicates with the additional utilization-side heat exchangers 301A-301C to build a refrigeration circuit and the third compressor 310C communicates with the utilization-side heat exchangers 380A-380C to build an air-conditioning circuit. The three compressors 310A-310C can be variable capacity compressors and/or fixed capacity compressors, depending on the requirements of the refrigerant apparatus. All of the three compressors 310A-310C are hermetic scroll compressors.

The shown heat exchange unit 200 further includes an injection pipe 206 fluidically connecting a gas side of the receiver 201 with a suction side of the first compressor 10, 310A, wherein the injection pipe 206 is configured to inject intermediate-pressure refrigerant collected by the receiver 201 into the first compressor 10, 310A. As shown in FIG. 7, the injection pipe 206 joins with two high-pressure pipes 207, 208 communicating between high-pressure sides of the second compressor 310B and the third compressor 310C and the suction side of the first compressor 10, 310A, before connecting to a suction side of the first compressor 10, 310A.

Additionally, the injection pipe 206 is provided with an expansion device 207, which is preferably located before the connection point of the injection pipe 206 with the high-pressure pipes 207, 208.

Description of Control Modes

First Example: Normal Refrigeration and Cooling Operation

As already mentioned above, FIG. 7 illustrates the refrigeration apparatus 300 in a normal refrigeration and cooling operation. Accordingly, all three compressors 310A-310C are turned on, which means, the second compressor 310B draws low pressure refrigerant from the additional utilization-side heat exchangers 301A-301C of the three coolers and the third compressor 310C draws refrigerant from the utilization-side heat exchanger 380C of one of the three indoor units. Via the high-pressure pipes 207, 208 the two compressors 310B, 310C provide intermediate-pressure refrigerant to the first compressor 310A, which further compresses the refrigerant and discharges high-pressure refrigerant which flows to the heat-source-side heat exchanger 11, which acts as a gas cooler. Such refrigerant is cooled by dissipating heat to outdoor air supplied by an outdoor fan. The high-pressure refrigerant flowing out from the heat-source-side heat exchanger 11 flows via the first fluid communication pipe 30 to the first switching mechanism 31, particularly the first valve 31A, which is a three-way valve. The three-way valve 31A is in a state, in which the first fluid communication pipe 30 is communicating with the third fluid communication pipe 50 and a flow to the second valve 31B is blocked. Hence, the high-pressure refrigerant flows directly to the expansion device 12, which is an expansion valve, without flowing through the thermal storage 20 or exchanging heat with the thermal storage 20 via the heat exchanger 102. Flowing through the expansion device 12, the pressure of the cooled high-pressure refrigerant is reduced, and the refrigerant is changed into intermediate-pressure refrigerant in a gas-liquid two-phase state (subcritical refrigerant).

Subsequently, the intermediate-pressure refrigerant flows to the receiver 201, a part of the refrigerant, particularly liquid intermediate-pressure refrigerant, flows from the receiver 201 to a first flow path 204A of the subcooling heat exchanger 204. The refrigerant flowing into the first flow path 204A is cooled by intermediate-pressure refrigerant flowing through the second flow path 204B, and the degree of subcooling of such refrigerant is increased. A part of the so subcooled liquid refrigerant flows through an expansion device 205, particularly a subcooling expansion valve, thereby reducing the pressure of the intermediate-pressure refrigerant further. The intermediate-pressure refrigerant flows into the second flow path 204B of the subcooling heat exchanger 204 and is evaporated by absorbing heat from the refrigerant flowing through the first flow path 204A of the subcooling heat exchanger 204.

The subcooled intermediate-pressure refrigerant flows so as to be branched into two main pipes providing the refrigerant to the refrigeration circuit and the air-conditioning circuit, where the refrigerant is branched again into three pipes providing the utilization-side heat exchangers 380A-380C of the indoor units and the additional utilization-side heat exchangers 301A-301C of the coolers with liquid refrigerant. Before entering the utilization-side heat exchangers 380A-380C, 301A-301C, the refrigerant flows through an expansion device, particularly an air-conditioning expansion valve or a cooler expansion valve, where the pressure of the intermediate-pressure refrigerant is reduced. Such refrigerant flows through the utilization-side heat exchangers and is evaporated by absorbing heat from example room air supplied by an air-conditioning fan of the indoor units.

The evaporated refrigerant of the utilization-side heat exchangers 380A-380C of the indoor units is rejoined and flows via a suction pipe back to a suction side of the third compressor 310C. The evaporated refrigerant of the additional utilization-side heat exchangers 301A-301C of the coolers is rejoined and flows via a suction pipe back to a suction side of the second compressor 310B. Thereby, the air-conditioning circuit and the refrigeration circuit are a closed loop. The evaporated refrigerant of the subcooling heat exchanger 204 is joined with intermediate-pressure refrigerant discharged from the second compressor 310B and the third compressor 310C and provided to the suction side of the first compressor 310A.

Additionally, gas intermediate-pressure refrigerant separated by the receiver 201 from the liquid intermediate-pressure refrigerant of the supercritical refrigerant, flows through an expansion device to reduce the pressure to a similar pressure as the pressure of the intermediate-pressure refrigerant discharged by the second compressor 310B and the third compressor 310C.

Second Example: Refrigeration Operation Using the Thermal Storage

Figure 8:
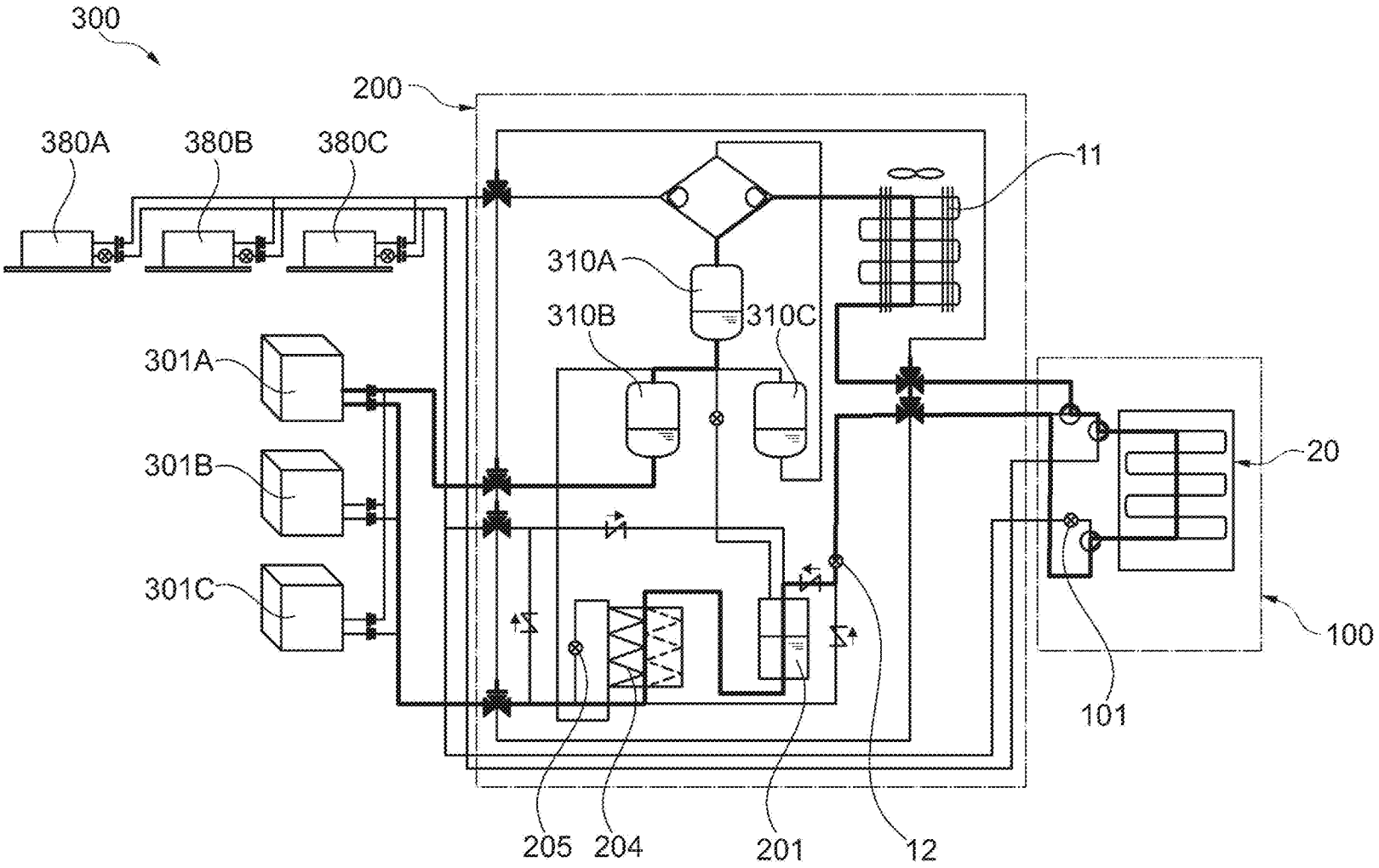
FIG. 8 is a refrigerant circuit diagram illustrating the refrigeration apparatus of FIG. 7 during a refrigeration operation using the thermal storage.

FIG. 8 is a refrigerant circuit diagram illustrating the refrigeration apparatus 300 of FIG. 7 during a refrigeration operation using the thermal storage. In this operation, the first switching mechanism 31, in particular the first and second valve, and the second switching valve are set in such a way that the high-pressure refrigerant flowing out from the heat-source-side heat exchanger 11 flows via the first fluid communication pipe 30 into the first and second valve and then into the thermal storage, thereby exchanging heat with the thermal storage 20. Flowing though the thermal storage 20 the high-pressure refrigerant is cooled. After leaving the thermal storage 20 the high-pressure refrigerant flows via the second switching mechanism via the expansion device 12 back to the receiver 201. By flowing through the expansion device 12, the pressure of the cooled high-pressure refrigerant is reduced and the refrigerant is changed into intermediate-pressure refrigerant in a gas-liquid two-phase state (supercritical refrigerant).

As described above, a part of the refrigerant, particularly liquid intermediate-pressure refrigerant, flows then from the receiver 201 to the first flow path 204A of the subcooling heat exchanger 204. The refrigerant flowing into the first flow path 204A is cooled by intermediate-pressure refrigerant flowing through the second flow path 204B, and the degree of subcooling of such refrigerant is increased. A part of the so subcooled liquid refrigerant flows through the expansion device 205 thereby reducing the pressure of the intermediate-pressure refrigerant further. The intermediate-pressure refrigerant flows into the second flow path 204B of the subcooling heat exchanger 204 and is evaporated by absorbing heat from the refrigerant flowing through the first flow path 204A of the subcooling heat exchanger 204.

The subcooled intermediate-pressure refrigerant flows then so as to provide the refrigerant only to the refrigeration circuit and not to the air-conditioning circuit, where the refrigerant is branched again into three pipes providing the additional utilization-side heat exchangers 301A-301C of the coolers with liquid refrigerant. Before entering the additional utilization-side heat exchangers 301A-301C, the refrigerant flows through the cooler expansion valve, where the pressure of the intermediate-pressure refrigerant is reduced. Such refrigerant flows through the additional utilization-side heat exchangers and is evaporated by absorbing heat from storage room air within the coolers.

Since the cooling operation is turned off, only the second compressor 310B and the first compressor 310A are in use, the third compressor 310 is turned off. Hence, the second compressor 310 draws low pressure refrigerant from the additional utilization-side heat exchangers 301A-301C of the coolers and provides intermediate-pressure refrigerant via the high-pressure pipe 207 to the first compressor 310A, which further compresses the refrigerant and discharges high-pressure refrigerant which flows to the heat-source-side heat exchanger 11, which acts as a gas cooler. Such refrigerant is cooled by dissipating heat to outdoor air supplied by an outdoor fan. The high-pressure refrigerant flowing out from the heat-source-side heat exchanger 11 flows then via the first fluid communication pipe 30 back to the first switching mechanism 31, thereby closing the refrigerant circuit.

Figure 9:
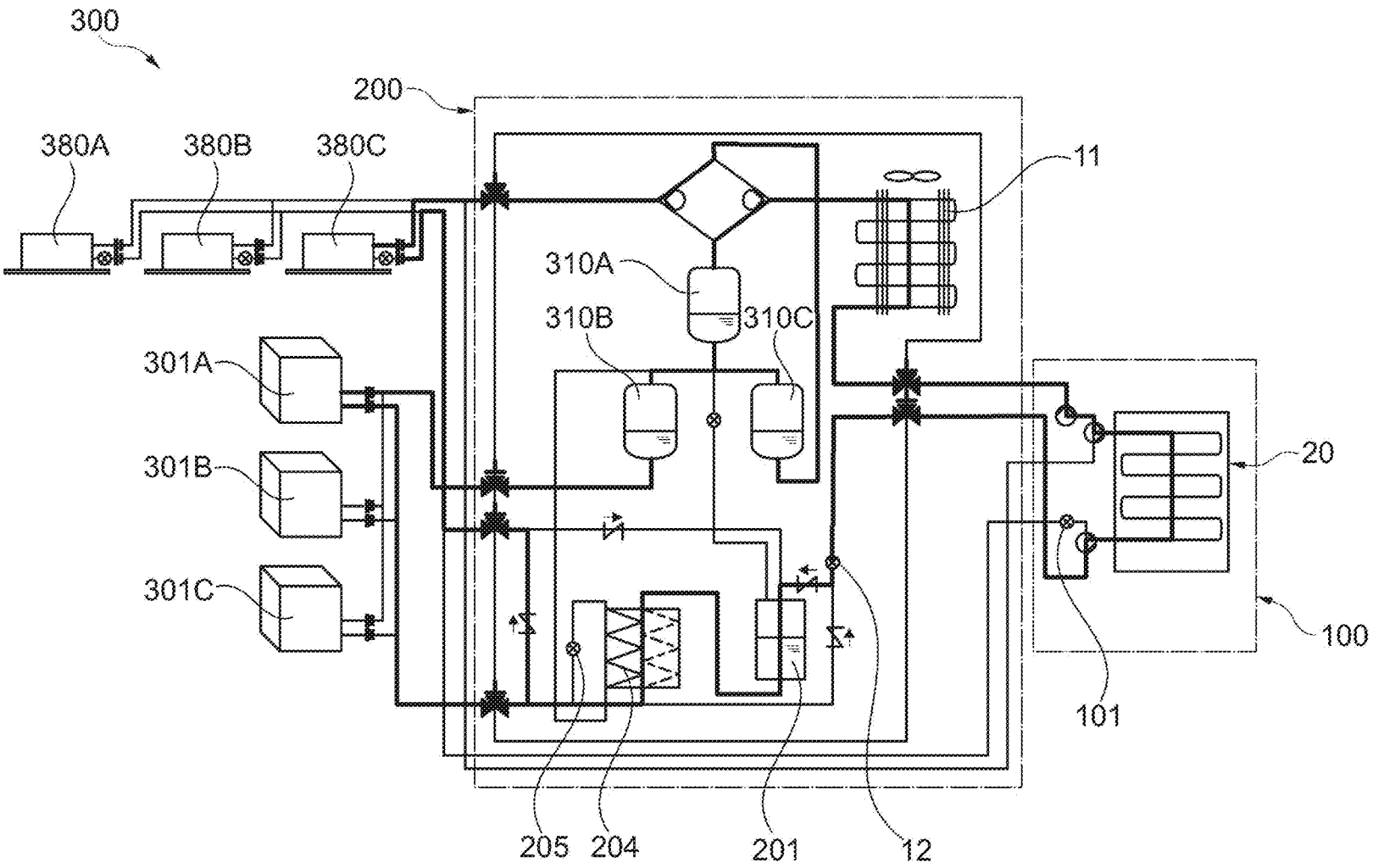
FIG. 9 is a refrigerant circuit diagram illustrating the refrigeration apparatus of FIG. 7 during a refrigeration and cooling operation using the thermal storage.

Third Example: Refrigeration and Cooling Operation Using the Thermal Storage FIG. 9 is a refrigerant circuit diagram illustrating the refrigeration apparatus of FIG. 7 during a refrigeration and cooling operation using the thermal storage. The refrigeration and cooling operation using the thermal storage is similar to the above with regard to FIG. 8 described refrigeration (only) operation using the thermal storage, except that all three compressors 310A to 310C are in use. Hence, the second compressor 310B draws low pressure refrigerant from the additional utilization-side heat exchangers 301A-301C of the three coolers and the third compressor 310C draws refrigerant from the utilization-side heat exchanger 380C of one of the three indoor units, which is the provided as intermediate-pressure refrigerant to the first compressor 310A, which further compresses the refrigerant and discharges high-pressure refrigerant which flows to the heat-source-side heat exchanger 11.

Such refrigerant flows then as described above through the thermal storage 20, the expansion device 12, the receiver 201, the subcooling heat exchanger 204 and is then branched into the two main pipes providing the refrigerant to the refrigeration circuit and the air-conditioning circuit, closing the refrigerant circuit.

Fourth Example: Only Charging Operation of the Thermal Storage

Figure 10:
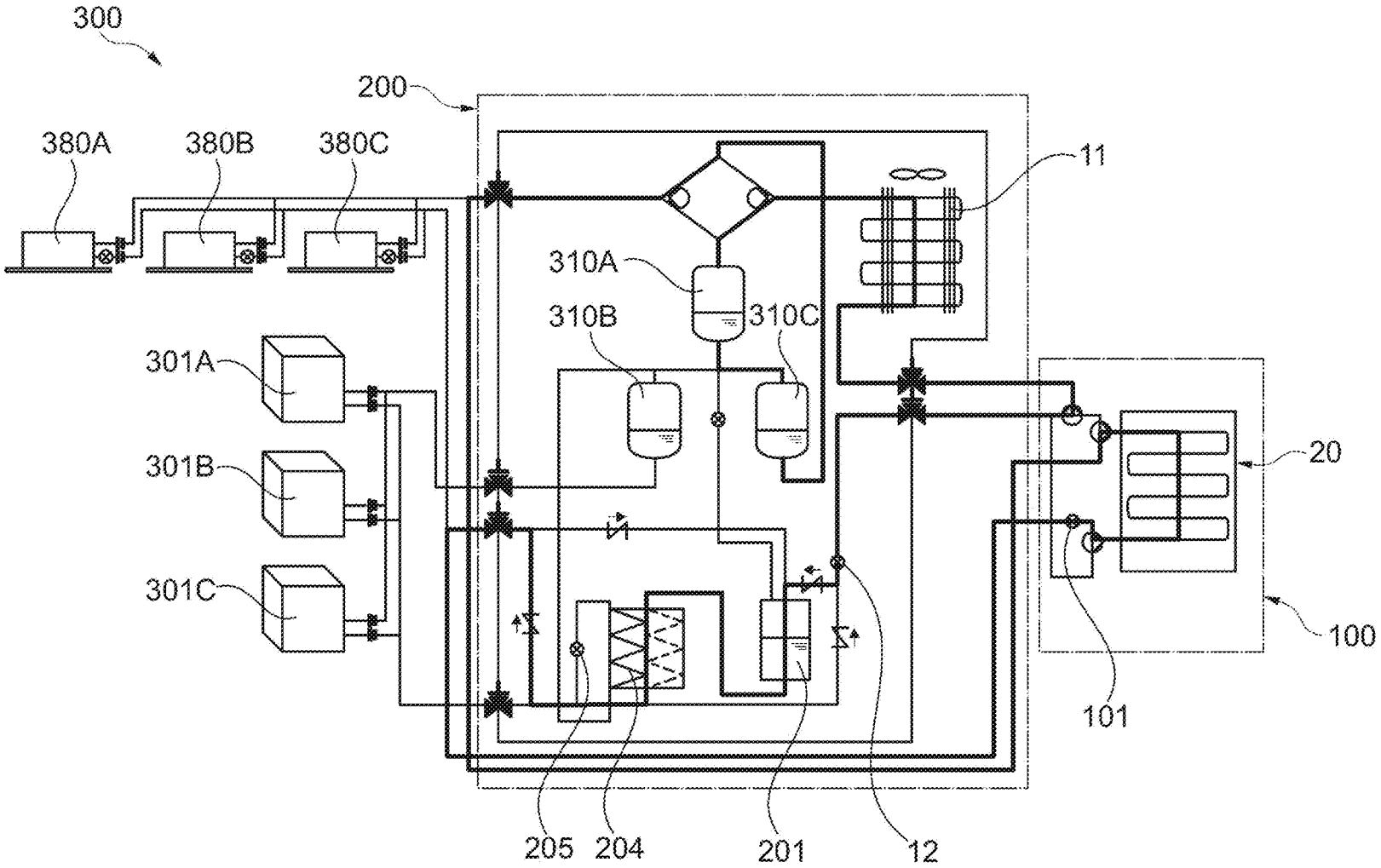
FIG. 10 is a refrigerant circuit diagram illustrating the refrigeration apparatus of FIG. 7 during an only charging operation of the thermal storage.

FIG. 10 is a refrigerant circuit diagram illustrating the refrigeration apparatus of FIG. 7 during an only charging operation of the thermal storage.

In this operation only the third compressor 310C and the first compressor 310A are in use, the second compressor 310B is turned off. The third compressor 310C draws the refrigerant directly from the thermal storage 20 and provides intermediate-pressure refrigerant to the first compressor which compresses the refrigerant further and discharges high-pressure refrigerant which flows to the heat-source-side heat exchanger 11, which acts as a gas cooler. The high-pressure refrigerant flowing out from the heat-source-side heat exchanger 11 flows then via the first fluid communication pipe 30 to the first switching mechanism 31. In this control mode the first valve 31A is set in such a manner that the high-pressure refrigerant flows as described above with FIG. 7 directly to the expansion device 12. From the expansion device 12 the intermediate-pressure refrigerant in a gas-liquid two-phase state (supercritical refrigerant) flows to the receiver 201 and from there liquid intermediate-pressure refrigerant flows then to the first flow path 204A of the subcooling heat exchanger 204. The refrigerant flowing into the first flow path 204A is cooled by intermediate-pressure refrigerant flowing through the second flow path 204B, and the degree of subcooling of such refrigerant is increased.

The subcooled intermediate-pressure refrigerant flows then via the second valve 31B back to the thermal storage 20 and by flowing through the thermal storage 20 cools the thermal storage 20, in particular the thermal storage material, thereby charges the thermal storage with cold.

Fifth Example: Refrigeration Operation while Charging the Thermal Storage

Figure 11:
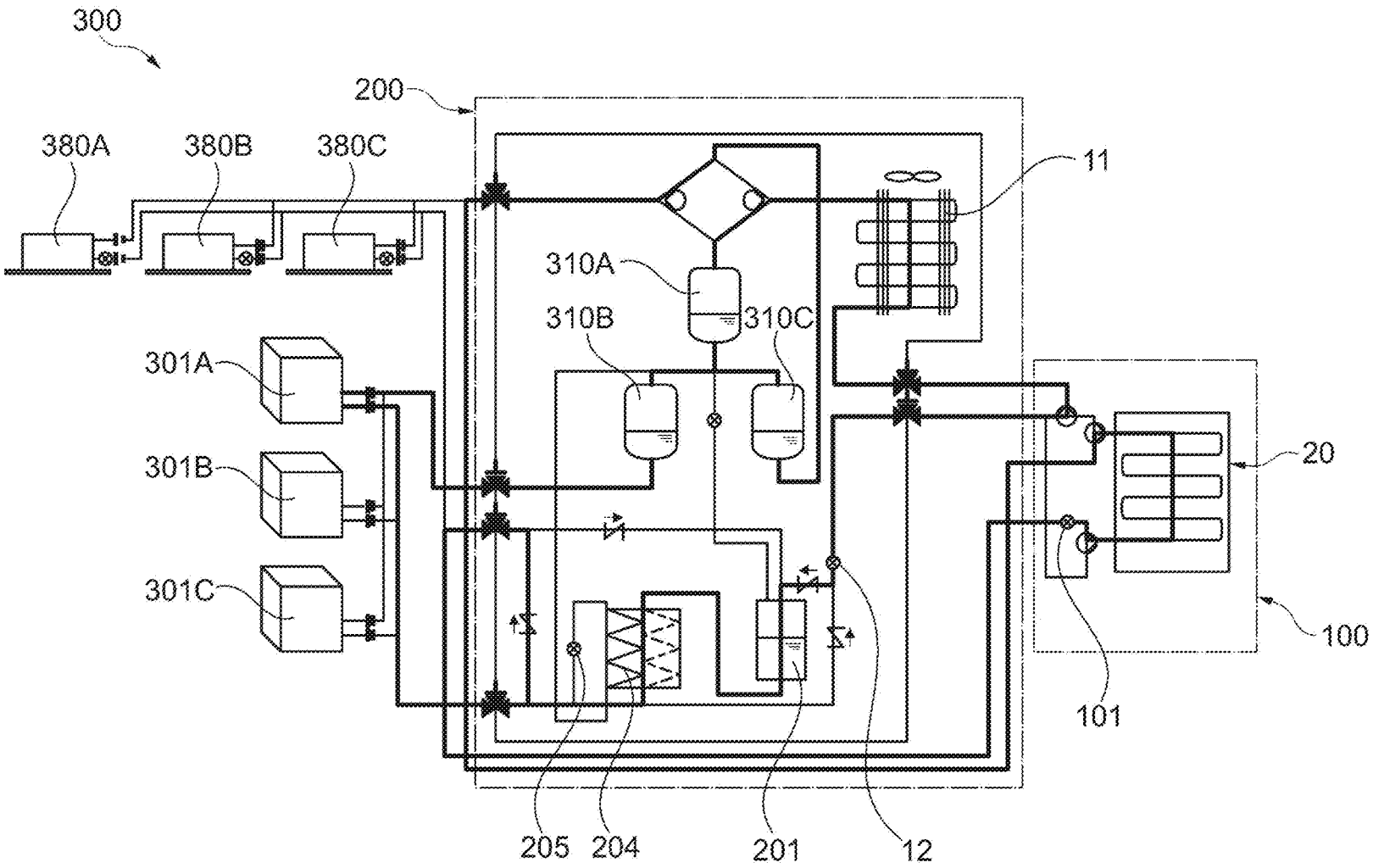
FIG. 11 is a refrigerant circuit diagram illustrating the refrigeration apparatus of FIG. 7 during a refrigeration operation while charging the thermal storage.

FIG. 11 is a refrigerant circuit diagram illustrating the refrigeration apparatus of FIG. 7 during a refrigeration operation while charging the thermal storage.

The refrigeration operation while charging the thermal storage is similar to the above with regard to FIG. 10 described only charging operation of the thermal storage, except that all three compressors 310A-310C are in use and that the second compressor 310B connects the additional utilization-side heat exchangers 301A-301C of the coolers to the refrigerant circuit 1. Thereby, it becomes possible not only to charge the thermal storage 20 with cold by flowing the subcooled intermediate-pressure refrigerant via the second valve 31B through the thermal storage 20, but also to provide the additional utilization-side heat exchangers 301A-301C with subcooled intermediate-pressure refrigerant. Meaning, the thermal storage 20 can be charged while performing a refrigeration operation.

Figure 12:
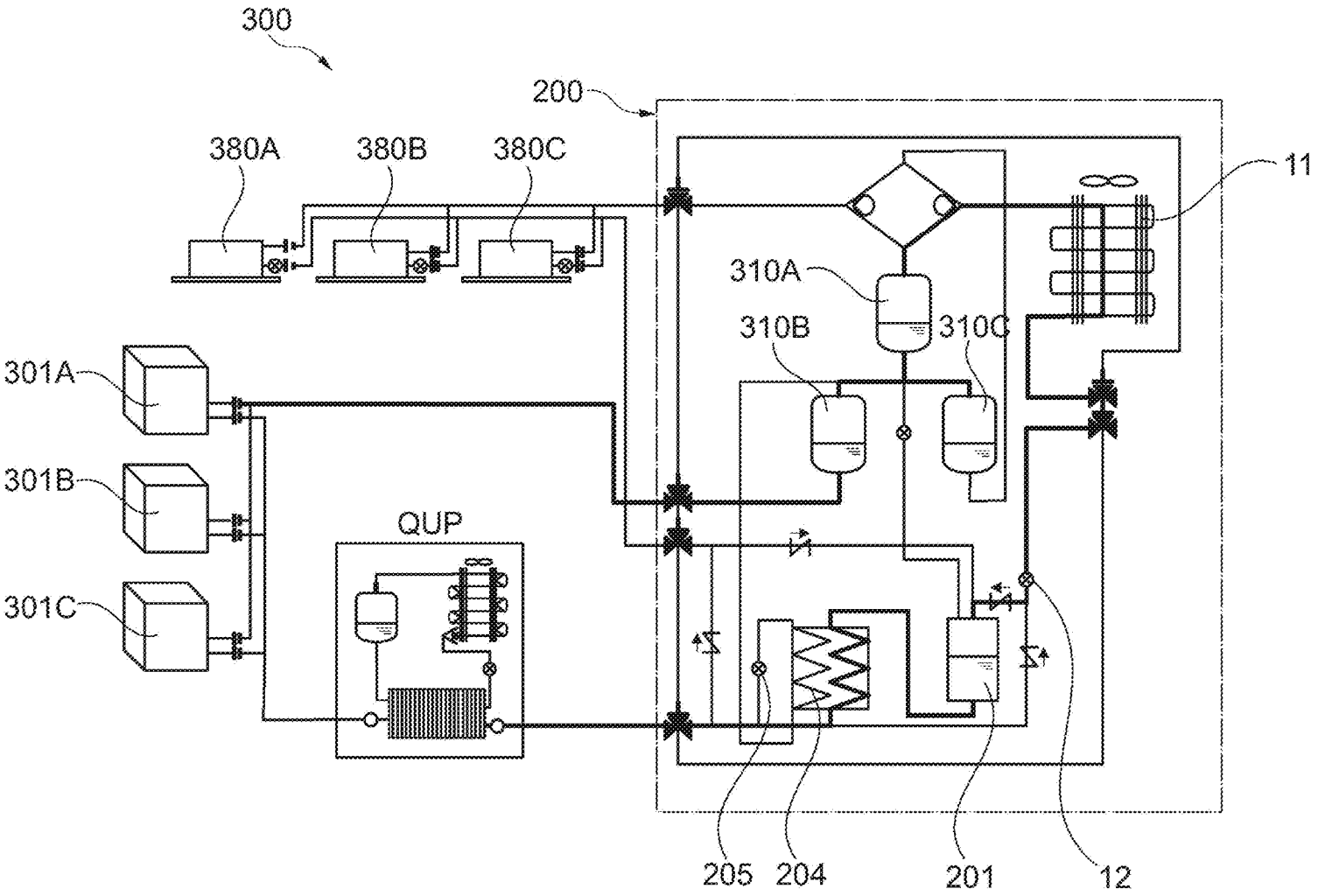
FIG. 12 is a refrigerant circuit diagram illustrating a configuration of a refrigeration apparatus of a second embodiment having a capacity increasing unit.

FIG. 12 is a refrigerant circuit diagram illustrating a configuration of a refrigeration apparatus 300 of a second embodiment having a capacity increasing unit 320. The refrigerant apparatus 300 of the second embodiment mostly corresponds to the refrigerant apparatus of the first embodiment described with regard to FIG. 7. However, instead of being provided with the thermal storage unit 100, the two connecting pipes connecting the second heat exchanger unit fluid port 32B and the third heat exchanger unit fluid port 52B have an open end. Meaning, the unit connected via the second and third heat exchanger unit fluid ports 32B and 52B with the refrigerant apparatus 300, in particular with the heat exchanger unit 200, is not shown. According to the present invention, instead of the thermal storage unit 100 also a heat exchanger, particularly a plate heat exchanger, a capacity increasing unit or a combi unit including a thermal storage unit and a capacity increasing unit can be connected to the heat exchanger unit 200.

FIG. 13 is a refrigerant circuit diagram illustrating a capacity increasing unit 320. The capacity increasing unit 320 is basically an independent refrigerant circuit that can be added to or connected with the refrigerant apparatus 300, in order to increase the refrigeration and cooling capacity of the refrigerant apparatus 300. As shown in FIG. 13, the capacity increasing unit 320 includes a heat exchanger, a compressor and an expansion device which build a closed refrigerant circuit. The heat exchanger is configured to exchange heat with the heat exchanger unit 200. Therefore, the heat exchanger can be connected with the second and third heat exchanger unit fluid ports 32B and 52B. Additionally, the capacity increasing unit 320 is provided with a heat-source-side heat exchanger that cools down the refrigerant flowing there through by dissipating heat to outdoor air supplied by an outdoor fan.

FIG. 14 is a refrigerant circuit diagram illustrating a combi unit 330 having a capacity increasing unit 320 and a thermal storage unit. As described above, the capacity increasing unit 320 includes a heat exchanger, a compressor and an expansion device which build a closed refrigerant circuit. Additionally, instead of connecting the heat exchanger directly with the refrigerant apparatus 300, in particular with the heat exchanger unit 200, the thermal storage unit is arranged between the heat exchanger unit 200 and the thermal storage unit. Accordingly, the combi unit 330 additionally includes a circulating pump that circulates a refrigerant or a coolant like water, cooled by the capacity increasing unit through the thermal storage unit, in order to charge the thermal storage unit with thermal energy, particularly cold. On the other side, the thermal storage unit is provided with a heat exchanger that is used to exchange heat with the refrigerant circuit of the refrigerant apparatus 300, in particular with the heat exchanger unit 200.

Moreover, the capacity increasing unit may include a closed refrigerant circuit including a heat exchanger, a compressor, a heat-source-side heat exchanger cooled by a fan and an expansion device, wherein the heat exchanger exchanges heat with the heat exchange unit.

According to a further aspect, the combi unit may include a capacity increasing unit, comprising a closed refrigerant circuit including a heat exchanger, a compressor, a heat-source-side heat exchanger cooled by a fan and an expansion device, and a thermal storage unit comprising a heat exchanger, a thermal storage, including a thermal storage material, particularly a phase changing material (PCM), and a circulating pump, wherein the heat exchanger exchanges heat with the heat exchange unit.

REFERENCE SIGNS LIST

1 Refrigerant Circuit
10 Compressor (First Compressor)
11 Heat-source-side heat exchanger
12 Expansion Device
20 Thermal Storage
21 Thermal Storage Material
22 Refrigerant Heat Exchange Pipe
30 First Fluid Communication Pipe
31 First Switching Mechanism
40 Second Fluid Communication Pipe
41 Second Switching Mechanism
50 Third Fluid Communication Pipe
60 First Gas Communication Pipe
70 Fourth Fluid Communication Pipe 70
80A Utilization-side Heat Exchanger
80B Additional Utilization-side Heat Exchanger
90 Heat Exchange Unit Gas Communication pipe
92 Heat Exchange Unit Gas Port 92
96 First Heat Exchange Unit Fluid Port
100 Thermal Storage Unit
72 First Thermal Storage Unit Fluid Port
32A Second Thermal Storage Unit Fluid Port
52A Third Thermal Storage Unit Fluid Port
62 Thermal Storage Unit Gas Port
31A First Valve
31B Second Valve
53 Check Valve
101 Expansion Device
102 Heat Exchanger
103 Circulating Pump
200 Heat Exchanger Unit
96 First Heat Exchanger Unit Fluid Port
32B Second Heat Exchanger Unit Fluid Port
52B Third Heat Exchanger Unit Fluid Port
201 Receiver
202 Third Heat Exchanger Unit Fluid Communication Pipe
203 Fourth Heat Exchanger Unit Fluid Port
204 Subcooling Heat Exchanger
205 Expansion Device (Subcooling Expansion Valve)
206 injection pipe
207 high pressure pipe
208 high pressure pipe
209 expansion device
210 fan
300 Refrigeration Apparatus
301A-301C Additional Utilization-side Heat Exchanger
310A First Compressor
310B Second Compressor
310C Third Compressor
320 Capacity Increasing Unit
330 Combi Unit
380A-380C Utilization-side Heat Exchanger

CITATION LIST

Patent Literature

[PTL 1] EP 2 402 681 A1
[PTL 2] EP 2 844 924 B1

The invention claimed is:

1. A refrigerant circuit for a refrigeration apparatus with a thermal storage, which is using $CO_2$ as refrigerant, comprising:

at least one compressor, a heat-source-side heat exchanger an expansion valve, and the thermal storage, including a phase changing material selected from paraffin, carbohydrate or lipid derived bio-based organic phase changing materials, and water, wherein the refrigerant circuit further comprises:

a first fluid communication pipe communicating between a fluid side of the heat-source-side heat exchanger and one side of the thermal storage, a second fluid communication pipe communicating between the expansion valve and another side of the thermal storage, a first switching valve located on the first fluid communication pipe and communicating among the heat-source-side heat exchanger, the thermal storage, a third fluid communication pipe, and a first gas communication pipe, and a second switching valve located on the second fluid communication pipe and communicating among the thermal storage, the expansion valve and a fourth fluid communication pipe, wherein the third fluid communication pipe communicates to the expansion valve and the first gas communication pipe communicates to a suction side of the compressor, and the fourth fluid communication pipe is communicating to a utilization-side heat exchanger.

2. The refrigerant circuit according to claim 1, wherein the first switching valve comprises:

a first valve, which is a three-way valve, communicating among the heat-source-side heat exchanger, the expansion valve and the thermal storage, and a second valve, which is a three-way valve and located between the first valve and the thermal storage, communicating among the first valve, the thermal storage and the first gas communication pipe.

3. The refrigerant circuit according to claim 1, wherein the first switching valve comprises:

a first valve, which is a four-way valve, communicating among the heat-source-side heat exchanger, the thermal storage, the first gas communication pipe and the expansion valve, wherein the first switching valve further comprises a check valve that stops a backflow from the third fluid communication pipe to the first valve.

4. The refrigerant circuit according to claim 1, wherein the second switching valve is a three-way valve, communicating among the thermal storage, the expansion valve and the utilization-side heat exchanger, wherein a storage side expansion valve is provided on the fourth fluid communication pipe, located between the second switching valve and the utilization-side heat exchanger.

5. The refrigerant circuit according to claim 1, further comprising a receiver, which is located on the third fluid communication pipe, between the expansion valve and the utilization-side heat exchanger, wherein the receiver is configured to separate liquid refrigerant from gas refrigerant.

6. The refrigerant circuit according to claim 1, further comprising a subcooling heat exchanger, which is located between the utilization-side heat exchanger and the expansion valve.

7. The refrigerant circuit according to claim 1, further comprising:

a storage side expansion valve, located on the fourth fluid communication pipe and between the second switching valve and the utilization-side heat exchanger, wherein the refrigerant circuit operates in different modes, which comprise:

a normal refrigeration and/or cooling mode, a cold storage making mode and a cold storage using mode, wherein:

in the normal refrigeration and/or cooling mode the first switching valve is set so that the first fluid communication pipe and the third fluid communication pipe are communicated, and the storage side expansion valve is closed, in the cold storage making mode the first switching valve is set so that the first fluid communication pipe and the third fluid communication pipe are communicated and the first gas communication pipe and the thermal storage are communicated, the second switching valve is set so that the fourth fluid communication pipe and the thermal storage are communicated, and the storage side expansion valve is opened, and in the cold storage using mode the first switching valve is set so that first fluid communication pipe and the thermal storage are communicated, the second switching valve is set so that the second fluid communication pipe and the thermal storage are communicated, and the storage side expansion valve is closed.

8. The refrigerant circuit according to claim 1, further comprising a thermal storage unit including the thermal storage and comprising a water circuit, a refrigerant to phase change material circuit or a refrigerant to water to phase change material circuit having a plate heat exchanger, and a circulating pump.

9. The refrigerant circuit according to claim 1, wherein the thermal storage unit includes the first switching valve and the second switching valve.

10. A method for controlling the refrigerant circuit according to claim 1, wherein the refrigerant circuit further comprises a storage side expansion valve, located on the fourth fluid communication pipe and between the second switching valve and the utilization-side heat exchanger, the method comprising different modes of operation, wherein the modes comprise:

a normal refrigeration and/or cooling mode, a cold storage making mode and a cold storage using mode, wherein:

in the normal refrigeration and/or cooling mode the first switching valve is set so that the first fluid communication pipe and the third fluid communication pipe are communicated, and the storage side expansion valve is closed, in the cold storage making mode the first switching valve is set so that the first fluid communication pipe and the third fluid communication pipe are communicated and the first gas communication pipe and the thermal storage are communicated, the second switching valve is set so that the fourth fluid communication pipe and the thermal storage are communicated, and the storage side expansion valve is opened, and in the cold storage using mode the first switching valve is set so that first fluid communication pipe and the thermal storage are communicated, the second switching valve is set so that the second fluid communication pipe and the thermal storage are communicated, and the storage side expansion valve is closed.

11. The refrigerant circuit according to claim 2, further comprising a receiver, which is located on the third fluid communication pipe, between the expansion valve and the utilization-side heat exchanger, wherein the receiver is configured to separate liquid refrigerant from gas refrigerant.

12. The refrigerant circuit according to claim 3, further comprising a receiver, which is located on the third fluid communication pipe, between the expansion valve and the utilization-side heat exchanger, wherein the receiver is configured to separate liquid refrigerant from gas refrigerant.

13. The refrigerant circuit according to claim 6 with the receiver, further comprising a heat exchange unit including the receiver and the subcooling heat exchanger.

14. The refrigerant circuit according to claim 7, further comprising an outside temperature sensor, a gas cooler out temperature sensor, a thermal storage medium temperature sensor, and a discharge side pressure sensor, provided on a high pressure side of the at least one compressor.

* * * * *